US007878434B2

(12) United States Patent
Grant et al.

(10) Patent No.: US 7,878,434 B2
(45) Date of Patent: Feb. 1, 2011

(54) WOOD CHIPPER

(75) Inventors: Donald Ryan Grant, Chester, PA (US); Stephen A. Matson, Phoeniville, PA (US); Robert E. Reitnour, Parker Ford, PA (US)

(73) Assignee: Country Home Products, Inc., Vergennes, VT (US)

( * ) Notice: Subject to any disclaimer, the term of this patent is extended or adjusted under 35 U.S.C. 154(b) by 188 days.

(21) Appl. No.: 12/275,362

(22) Filed: Nov. 21, 2008

(65) Prior Publication Data

US 2010/0127107 A1 May 27, 2010

(51) Int. Cl.
*B02C 18/22* (2006.01)

(52) U.S. Cl. ..... 241/37.5; 241/92; 241/101.76

(58) Field of Classification Search ..... 241/92, 241/37.5, 101.76
See application file for complete search history.

(56) References Cited

U.S. PATENT DOCUMENTS

| | | | | |
|---|---|---|---|---|
| 2,181,397 | A | 11/1939 | Everett | |
| 2,327,308 | A | 8/1943 | Johnston | |
| 2,557,344 | A | 6/1951 | Erickson | |
| 2,595,100 | A | 4/1952 | Ravers, Jr. | |
| 2,705,597 | A | 4/1955 | Erickson | |
| 4,063,750 | A | 12/1977 | Mutchler | |
| 4,619,463 | A | 10/1986 | Weaver | |
| 4,834,302 | A | 5/1989 | Baker | |
| 5,005,620 | A * | 4/1991 | Morey | 144/373 |
| 5,060,873 | A | 10/1991 | Strong | |
| 5,137,219 | A | 8/1992 | Morey | |
| 5,205,496 | A * | 4/1993 | O'Donnell et al. | 241/34 |
| 5,358,189 | A | 10/1994 | Vandermolen | |
| 5,381,970 | A | 1/1995 | Bold et al. | |
| 5,390,865 | A | 2/1995 | Vandermolen et al. | |
| 5,603,459 | A | 2/1997 | Gearing et al. | |
| 5,669,563 | A | 9/1997 | Gearing et al. | |
| 5,692,548 | A | 12/1997 | Bouwers et al. | |
| 5,692,549 | A * | 12/1997 | Eggers | 144/247 |
| 5,707,017 | A | 1/1998 | Paolucci et al. | |
| 6,148,882 | A | 11/2000 | Nettles | |
| 6,290,155 | B1 * | 9/2001 | Thompson et al. | 241/92 |
| 6,435,432 | B1 | 8/2002 | Doskocil | |
| 6,910,648 | B1 | 6/2005 | Reinhold | |
| 2004/0089754 | A1 | 5/2004 | Strong | |

* cited by examiner

*Primary Examiner*—Mark Rosenbaum
(74) *Attorney, Agent, or Firm*—Mattingly & Malur, P.C.

(57) ABSTRACT

A wood chipper includes a housing having an inlet opening and a discharge outlet with a chipper disk rotatably mounted in the housing and having a chipper knife mounted on a front face thereof adjacent a chipper slot extending through the disk. A plurality of fins are mounted on the back face of the chipper disk. An inlet hopper is connected to the inlet opening and a blow back shield is mounted in the upper end portion of the hopper with the shield including an outer layer of clear synthetic material extending across the hopper and an inner layer of synthetic material extending part way underneath the length of the layer of clear synthetic material. The inner layer may be provided with a safety warning thereon which is visible through the outer layer of clear synthetic material. A discharge chute is connected to the discharge outlet which has inwardly angled plates around part thereof. Vent holes are provided in a wall of the housing which add air flow to the wood chipper when it is being operated.

12 Claims, 9 Drawing Sheets

WOOD CHIPPER

BACKGROUND OF THE INVENTION

1. Field of the Invention

The present invention relates to an improved wood chipper and, more particularly, a rapid self feeding wood chipper of the disk type wherein a cutting knife is carried rotatably on the face of a spinning disk.

2. Description of the Related Art

Many types of wood chippers are well known and are used to chip trees, brush, branches, twigs, bushes and the like into wood chips. The wood chippers come in a wide variety of types and sizes.

A conventional wood chipper of the disk type includes a spinning disk regularly carrying one or more cutting knives on a cutting face thereof and mounted in a housing. An inlet hopper is connected to an inlet opening of the housing and a discharge chute is connected to a discharge outlet of the housing.

There is a need in the art for a disk type wood chipper wherein the wood or other material to be chipped can be rapidly and easily received in the inlet hopper and then be self feed. It is further important that the inlet hopper be provided with a suitable blowback cover and a safety warning. Moreover, it is desirable to have an adequate air flow through the system so that the wood chips may be efficiently discharged through a discharge chute.

SUMMARY OF THE INVENTION

It is an object of the present invention to provide an improved wood chipper having a large inlet hopper with a blow back shield mounted at the top thereof and which includes a first outer layer of a clear plastic material and a second inner layer of a plastic material extending part way underneath the length of the first outer layer of clear plastic material and having safety warning information thereon which is visible through the outer layer of clear plastic material.

Another object of the invention is to provide a wood chipper with a discharge outlet from the chipper housing having inwardly angled plates around at least a part of the discharge outlet to focus material being discharged towards a center of a discharge chute and to help prevent clogging.

A further object of the invention is to provide a wood chipper having vent holes in a wall of the chipper housing which add air flow to the housing to improve the flow of chipped material out through the discharged chute and help prevent clogging.

Still another object of the present invention is to provide a wood chipper having an inlet hopper with integral handle holes thereon which may be easily gripped to manually move the wood chipper.

A still further object of the invention is to provide a wood chipper mounted on a wheeled platform and having a hitch connected thereto whereby the wood chipper may be easily towed.

The present invention achieves the above and other objects by providing a wood chipper which includes a housing mounted on a wheeled platform and having an inlet opening and a discharge outlet. The housing has a chipper disk rotatably mounted therein with a chipper knife mounted on an axial front cutting face thereof and a chipper slot adjacent the chipper knife and extending through the front cutting face to an axial back face whereby wood chips which are cut by the chipper knife may flow through the slot to the backside of the chipper disk. A plurality of fins are mounted on the back face of the chipper disk whereby the fins create an airflow and also hit the chip material which passes through the slots and impels the chips to the discharge outlet. A motor is provided for driving the chipper disk. An inlet hopper is connected to the housing inlet opening and a blow back shield is mounted to an upper end portion of the hopper with the shield including an outer layer of clear synthetic material extending across the hopper and an inner layer of synthetic material extending part way underneath the length of the layer of clear synthetic material and having safety warning information thereon which is visible through the outer layer of clear plastic material.

The wood chipper further includes inwardly angled plates around at least a part of the discharge outlet which focus material being discharged toward the center of the discharge chute. Vent holes are also provided in the back wall of the housing adjacent the discharge outlet which adds airflow to the inside of the housing. Handle holes may be provided adjacent a top portion of a back wall of the inlet hopper so that the wood chipper may be easily manually moved. The discharge chute should also may be mounted for swivel movement with respect to the discharge outlet whereby the chips being discharged can be sent in a desired direction.

These, together with other objects and advantages, which will be subsequently apparent, reside in the details of construction and operation as more fully described and claimed hereafter, reference being made to the accompanying drawings forming a part hereof, wherein like numerals refer to the like parts throughout.

DETAILED DESCRIPTION OF THE PREFERRED EMBODIMENTS

Figure 1:
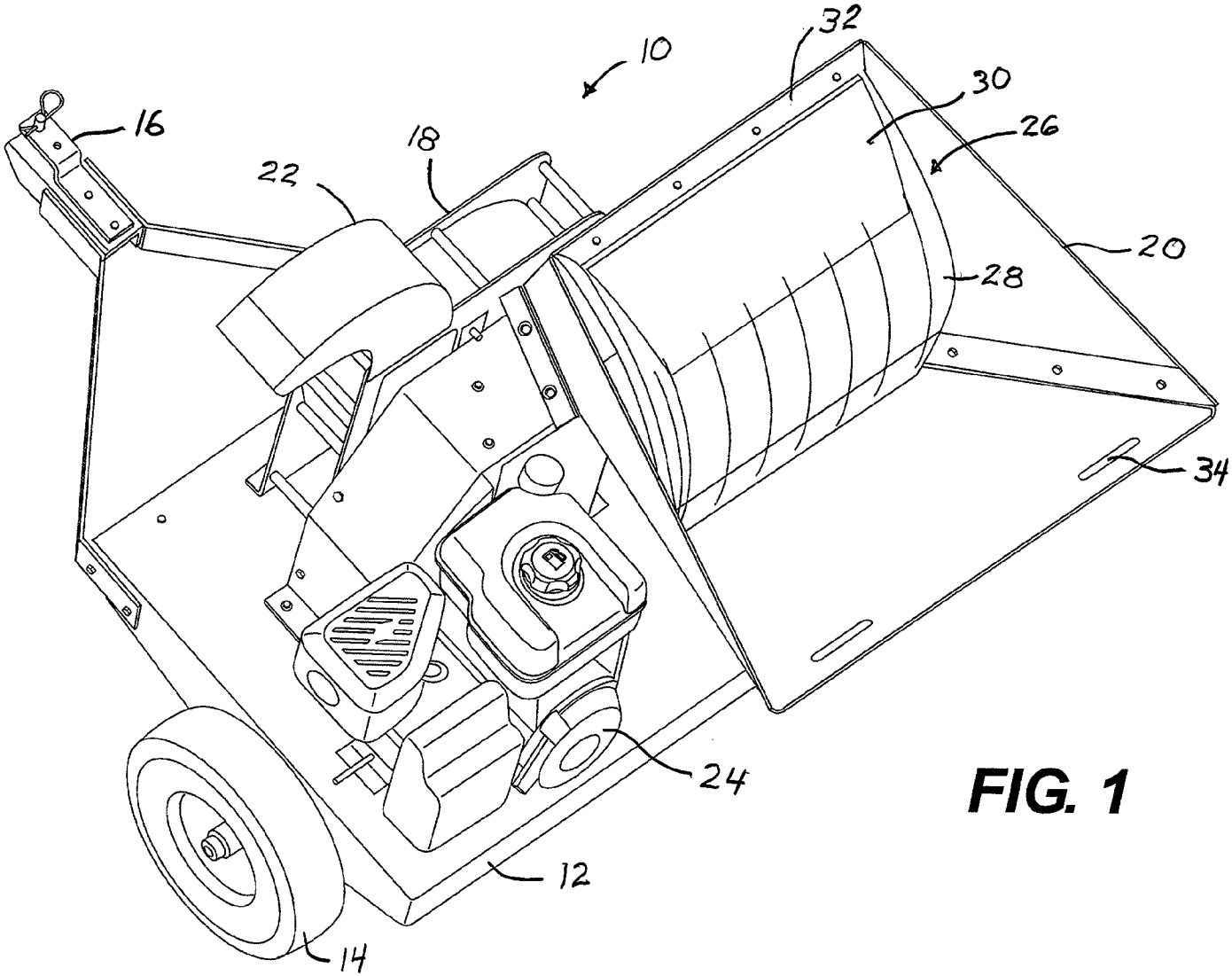
FIG. 1 is a top perspective view of a wood chipper according to the present invention.

Referring to the drawings, a wood chipper, generally referred to by the numeral 10, is shown which includes a platform 12 having wheels 14 mounted thereon so that the wood chipper is easily portable. The platform has a hitch 16 attached to the front thereof so that the wood chipper may be easily towed by a vehicle.

A chipper housing 18 is mounted on the platform and has a rotary cutting disk 44 mounted inside which is rotatable through power supplied by a suitable motor 24. The inlet hopper has a discharge chute 22 attached thereto to discharge materials processed through the wood chipper. An inlet hopper 20 is connected to the backside of the housing 18 whereby material to be chipped can be feed to the rotary disk in the chipper housing.

Figure 3:
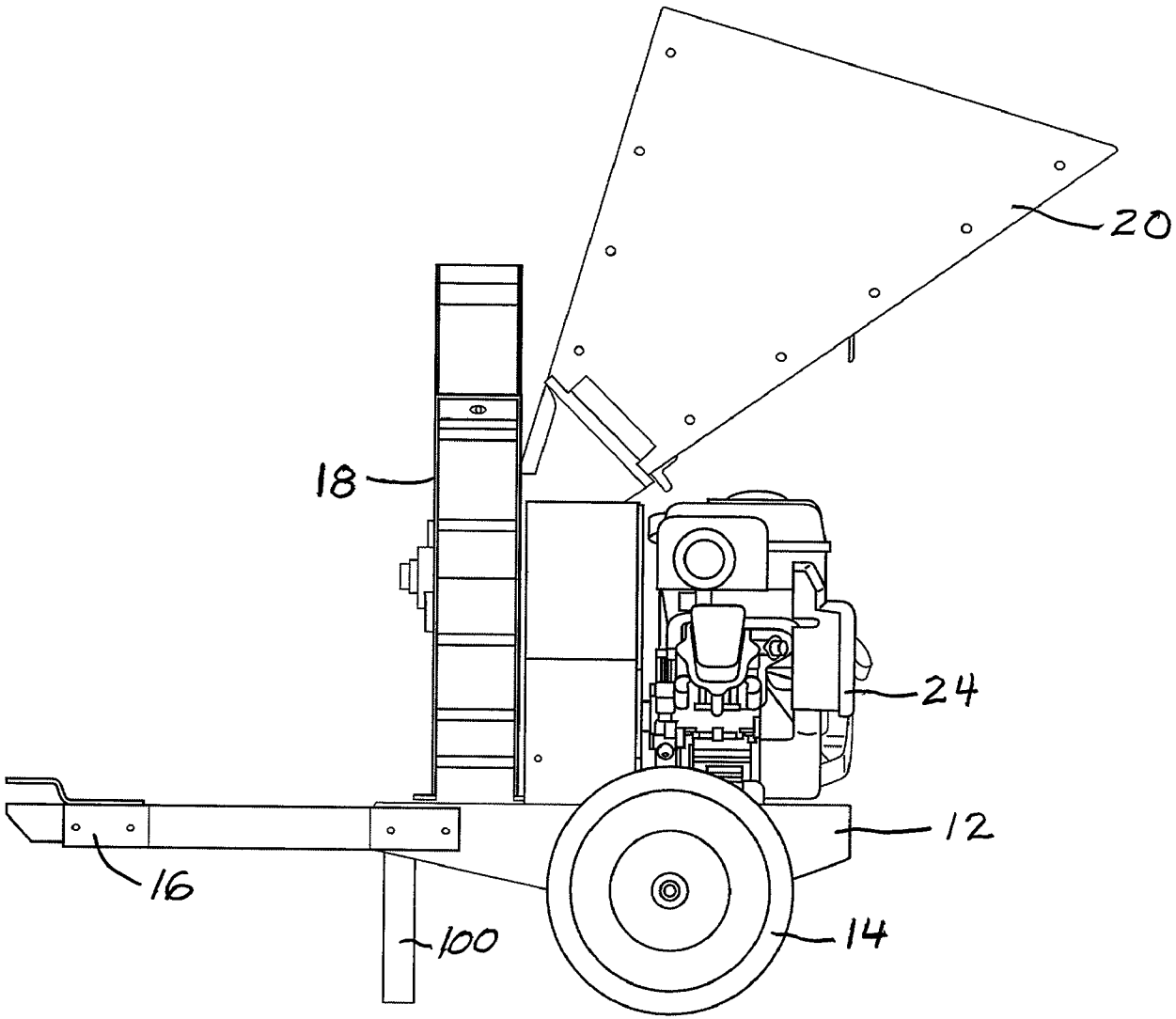
FIG. 3 is a right side elevational view of the wood chipper shown in FIG. 1.

As shown in FIGS. 1 and 3, the inlet hopper 20 extends upwardly from the housing 18 at a suitable angle so that material to be chipped can flow by gravity through the hopper to the housing to be chipped. The inlet hopper is an oversized hopper which will take saplings in small trees with little to no pruning of side branches. While reference is made throughout to wood material, other material also may be chipped.

A blow back shield 26 is attached to the top front rim of the inlet hopper as shown in FIG. 1. The blow back shield is comprised of an outer layer 28 of a clear synthetic material such as plastic and an inner layer 30 of a synthetic material such as plastic which preferably is of a yellow color and which extends part way underneath a length of the layer of clear plastic material. Both layers of synthetic material of a width sufficient to extend across the width of the inlet hopper. The layers are held in place by a bracket 32 and suitable rivets or bolts which extend there through to attach the bracket and the layers of plastic to the top at the front of the inlet hopper. The layers of synthetic material are of heavy enough plastic that they spring back to a normally closed position after material passes thereby.

The inner layer of color plastic material 30 is provided with a safety warning such as a warning indicating no hands are allowed in the area covered by the inner layer of plastic. By having the outer layer of clear plastic, the safety warning can be easily seen by an operator. When material to be chipped is pushed into the hopper, the two layers of the blow back shield are pushed forwardly and the material is allowed to proceed downwardly in the chute to the housing 18. Moreover, the synthetic or plastic material from which the two layers are constructed has sufficient resilience so that it snaps back into place after the material being chipped passes through the hopper. In addition, the inner layer provides further support for the outer layer and contributes to the ability of the blow back shield to snap back in place.

The hopper 20 is provided with handle holes 34 adjacent the top backside thereof so that an operator standing behind the wood chipper may grab the inlet hopper by the handle holes to move the wood chipper. Since the hopper extends upwardly several feet, the handle holes are at a height which makes it ergonomically comfortable for an operator to grip the hopper and transport the machine. The machine's center of gravity is positioned such that it is easy to manipulate the machine over uneven terrain and to transition from moving the unit to a chipping position.

Figure 2:
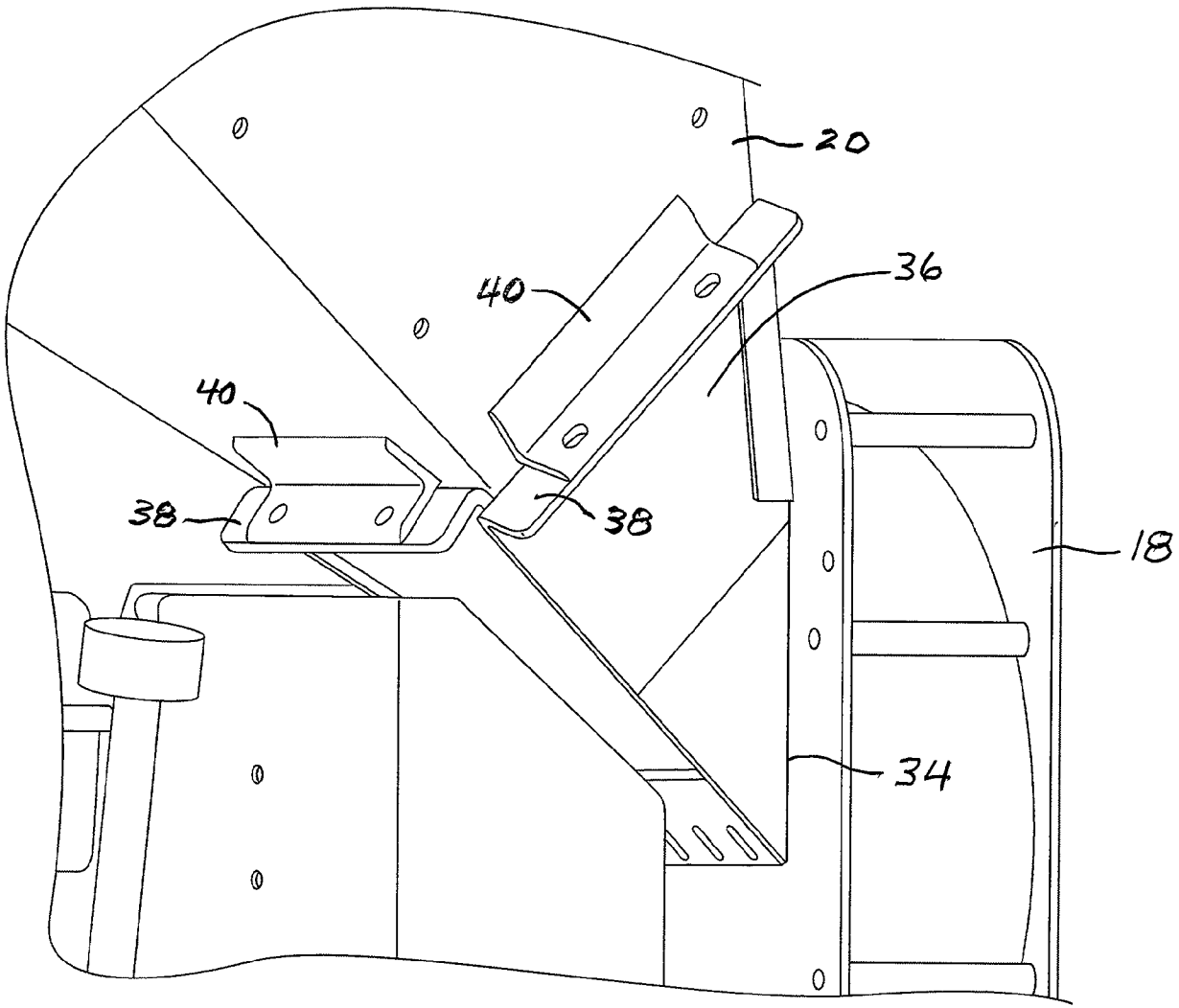
FIG. 2 is an enlarged perspective view illustrating the manner in which the inlet hopper is attached to a hopper neck which in turn is attached to a housing.

The inlet hopper includes a neck portion 36 as shown in FIG. 2 for connecting the hopper to the inlet 34 of the housing 18. The neck portion has flanges 38 on the outside thereof which mate with flanges 40 on the inlet hopper whereby the neck portion may be securely attached to the hopper by means of suitable fasteners such as bolts inserted through holes of the flanges. By having the connecting bolts on the outside of the neck and the hopper, the hopper may be easily removed from the neck portion. The inner end of the neck 36 may be attached to the housing 18 by suitable attaching means such as welding.

Figure 6:
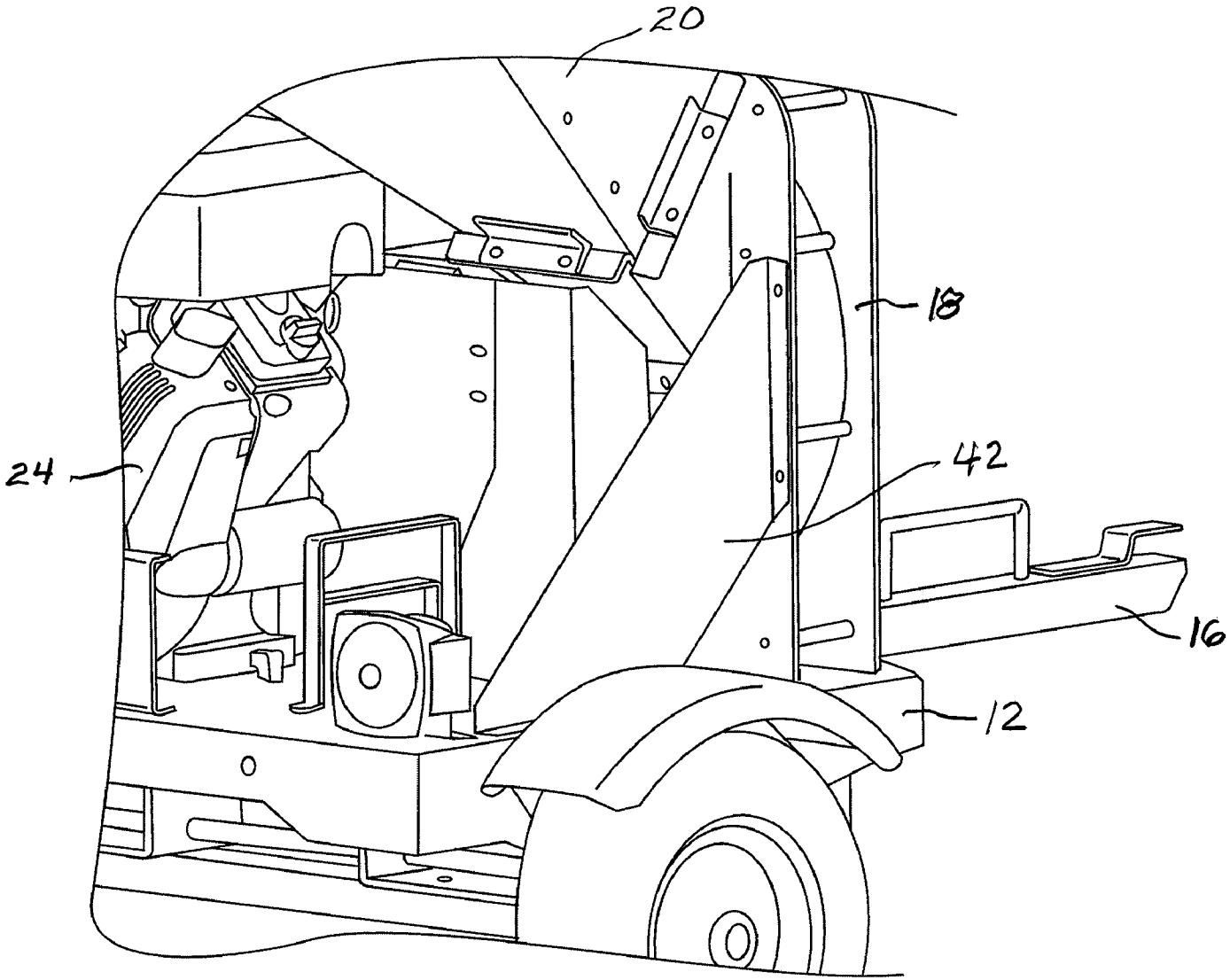
FIG. 6 is an enlarged perspective view illustrating a large gusset brace supporting the housing from the platform of the wood chipper.

As shown in FIG. 6, the housing 18 is securely attached to the platform 12 by a large gusset or brace 42 which extends diagonally between the top of the platform and the back face of the housing. The brace strengthens the entire wood chipper and enables it to process material faster and smoother since the base creates lateral support that also benefits the driveline by reducing deflection between the chipper and the engine.

Figure 5:
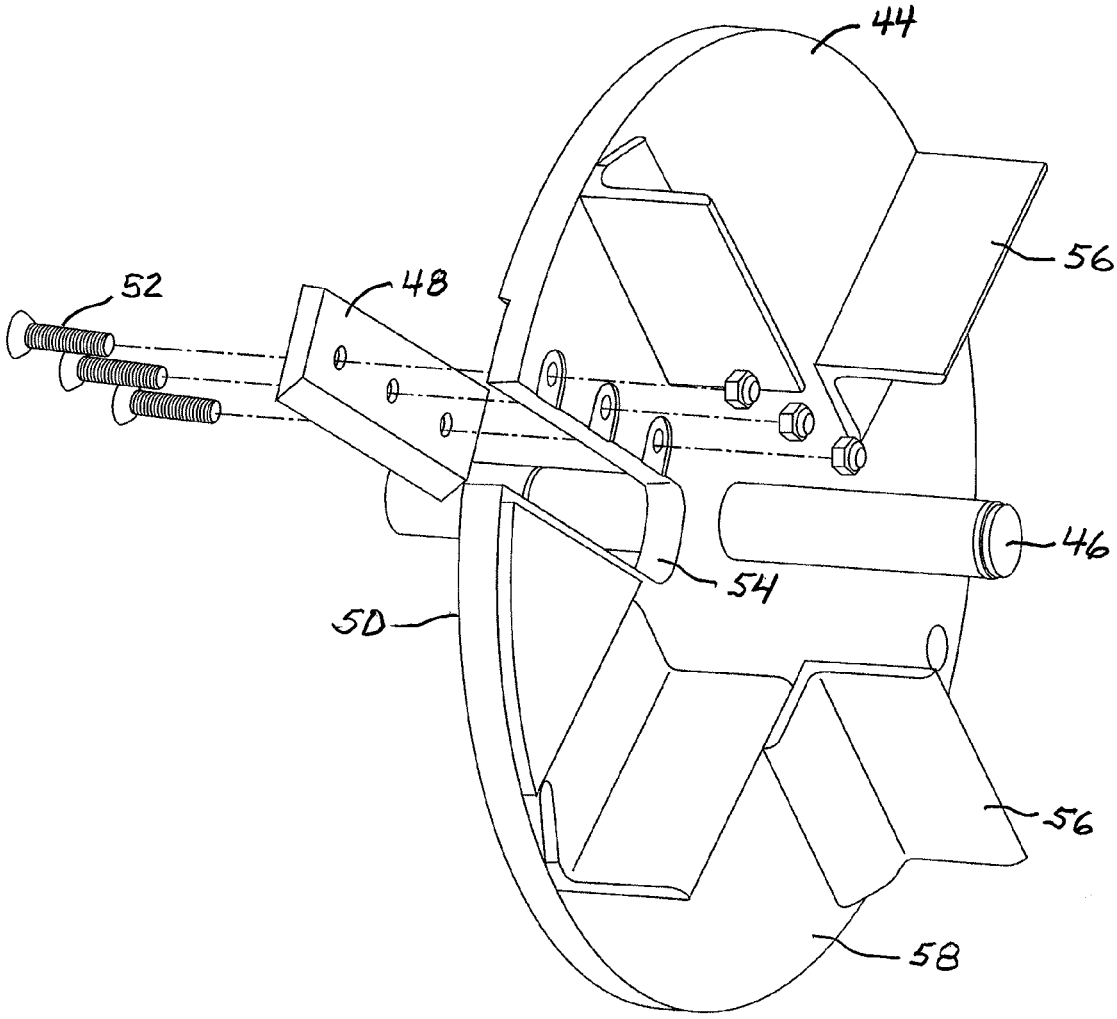
FIG. 5 is an enlarged perspective view illustrating a chipper disk with a chipper knife to be attached to the front face and fins attached to the back face of the disk.

The chipper disk 44 is mounted on a rotatable shaft 46 inside of the housing 18 as shown in FIG. 5. The shaft 46 is operatively connected to an output shaft of the motor 24 by suitable means such as gearing or a belt. Alternate drive means may also be used such as a power takeoff from a tractor.

A chipper knife 48 is removably attached to an axial front cutting face 50 of the chipper disk by suitable fastening means such as bolts 52 which extend through the chipper knife and openings in the disk. The chipper knife 48 is attached to the disk adjacent a slot 54 which extends through the chipper disk. While only one chipper knife and slot combination is disclosed, additional knives and slots may be employed.

The chipper knife 48 has a cutting edge 60 which is angled inwardly from the front face thereof whereby when material is chipped, the angled cutting edge and angled face associated therewith direct the chips into the slot 54 so that the chips easily pass through the slot to the back face 58 of the cutting knife. A plurality of fins 56 are mounted to the back face of the disk 44 so that when material is processed by being chipped, the chips created by the knife easily flow through the chipper slot through the back side of the chipper disk and then contact and are objected by the fins from the housing 18 through a discharge outlet 62.

Figure 8:
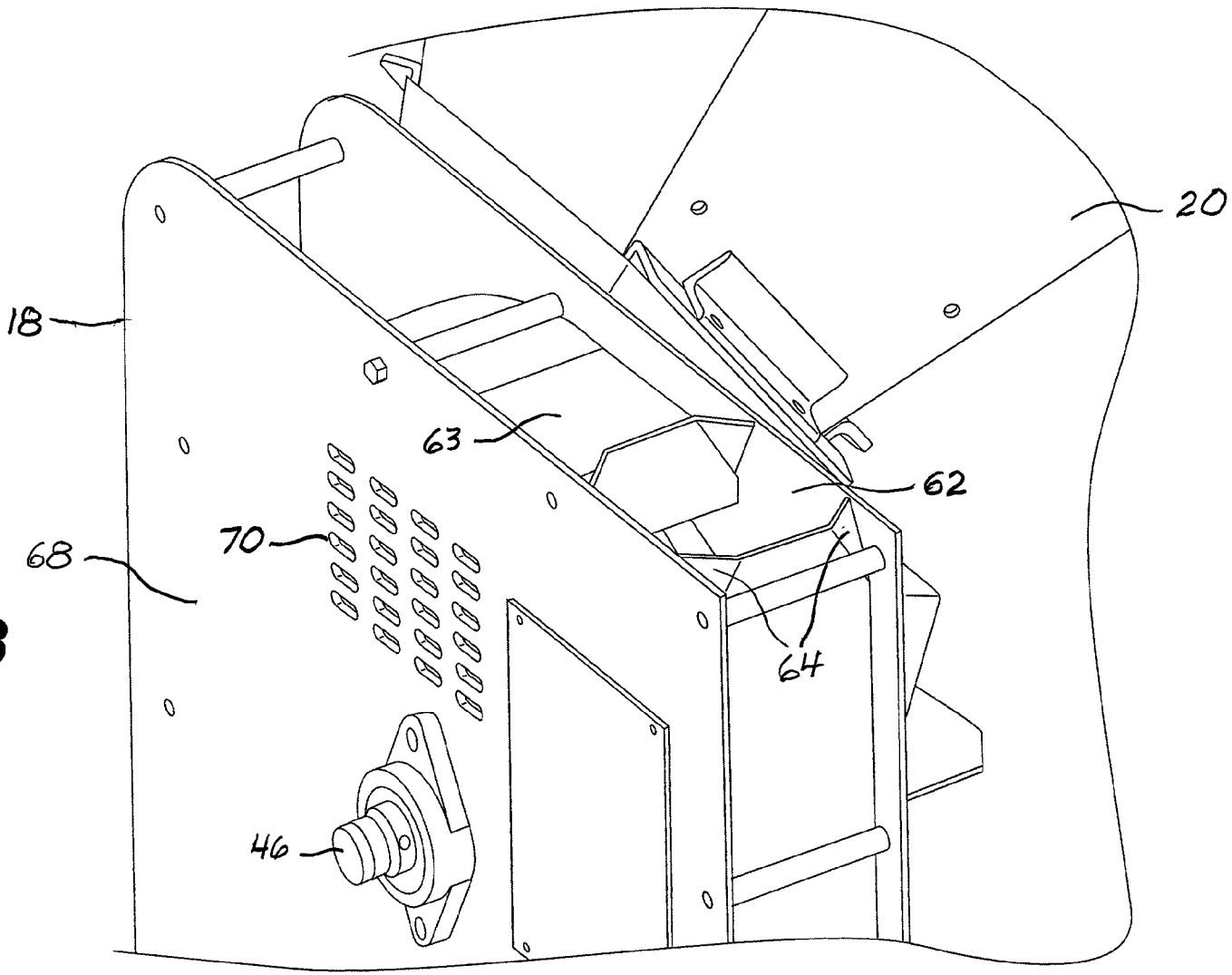
FIG. 8 is an enlarged perspective view of the top of the housing showing air vents in a back wall and inwardly angled plates mounted around the discharge outlet.

It is shown in FIG. 8, the discharge outlet 62 of the chipper housing 18 is provided at the top of the housing on one end thereof. As shown, the discharge outlet 62 has a generally rectangular configuration and is provided with plates 62 at each corner thereof which angle inwardly. These plates are sometimes referred to as dog ears. The discharge chute 62 is provided at the end of a scroll 63 of the housing which surrounds the chipper disk. The small angled plates act like a nozzle directing the discharge of chips in an appropriate direction and focus the spray toward the center of the discharge chute 22. As shown in FIG. 1 the discharge chute 22 is attached to the top of the discharge outlet 62. The inwardly angled plates 64 also keep the chips and other material discharge away from any corners or edges that otherwise might propagate a clog in the discharge outlet. This adds reliability to the wood chipper.

As also shown in FIG. 8, vent hole 70 are provided on the front side 68 of the chipper housing through which air may enter the inside of the housing when the chipper disk rotates. The use of the vent holes allows more air into the system so that the chipper is able to discharge more air out of the discharge chute and improve the air flow. This also contributes to help the machine avoid clogging. As shown in FIG. 8, the location size, size and number of the vent holes insures optimal performance.

Figure 9:
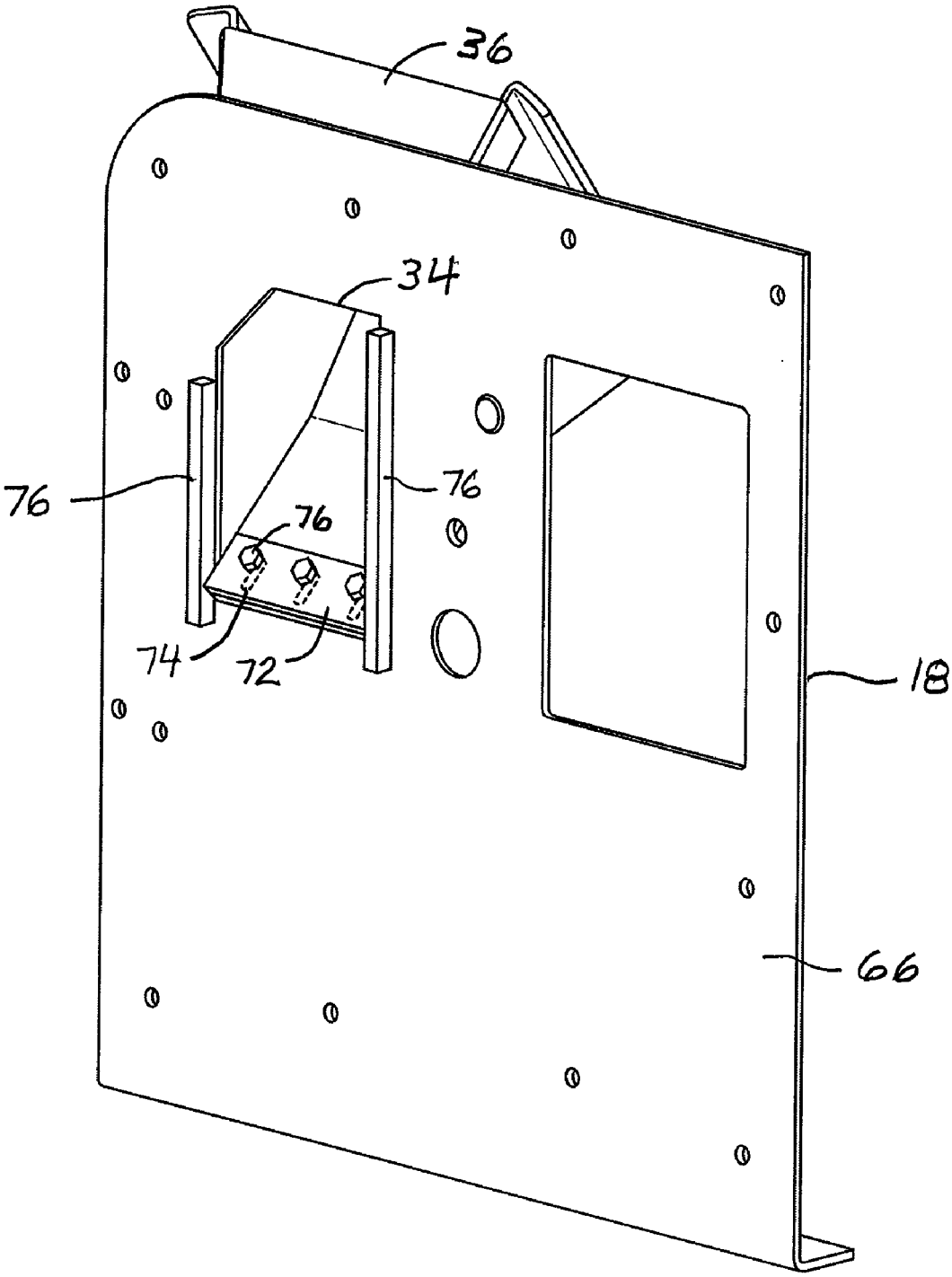
FIG. 9 is an enlarged perspective view showing the inside of the front plate of the housing and illustrating the inlet hopper neck and having a wear plate and side anvil mounted around the inlet opening.

As shown in FIG. 9, the housing inlet 34 opens through the back side 66 of the chipper housing and the neck 36 of the inlet hopper 20 is attached to the outside of the inlet opening. The bottom of the hopper neck is provided at the front end thereof with a replaceable wear plate 72 which is held in place by bolts 76 inserted in slots 74 in the bottom of the hopper neck. These slots 74 permit the wear plate to be adjusted forwardly and backwardly. The wear plate 72 also acts as an anvil when material is chipped. A side anvil 76 is attached to each side of the inlet opening on the inside of the inlet hopper. The side anvils further support the material passing there through as it is being chipped and insure easy processing of a variety of materials. The side anvils not only prevent the wood from vibrating but also prevent vines from wrapping around the shaft 46 of the chipper disk or avoiding the path of the chipper knife as the chipper disk rotates. This specific combination of features at the inlet opening and the hopper neck all work together to create a wood chipper that processes a variety of material smoothly and quickly.

Figure 7:
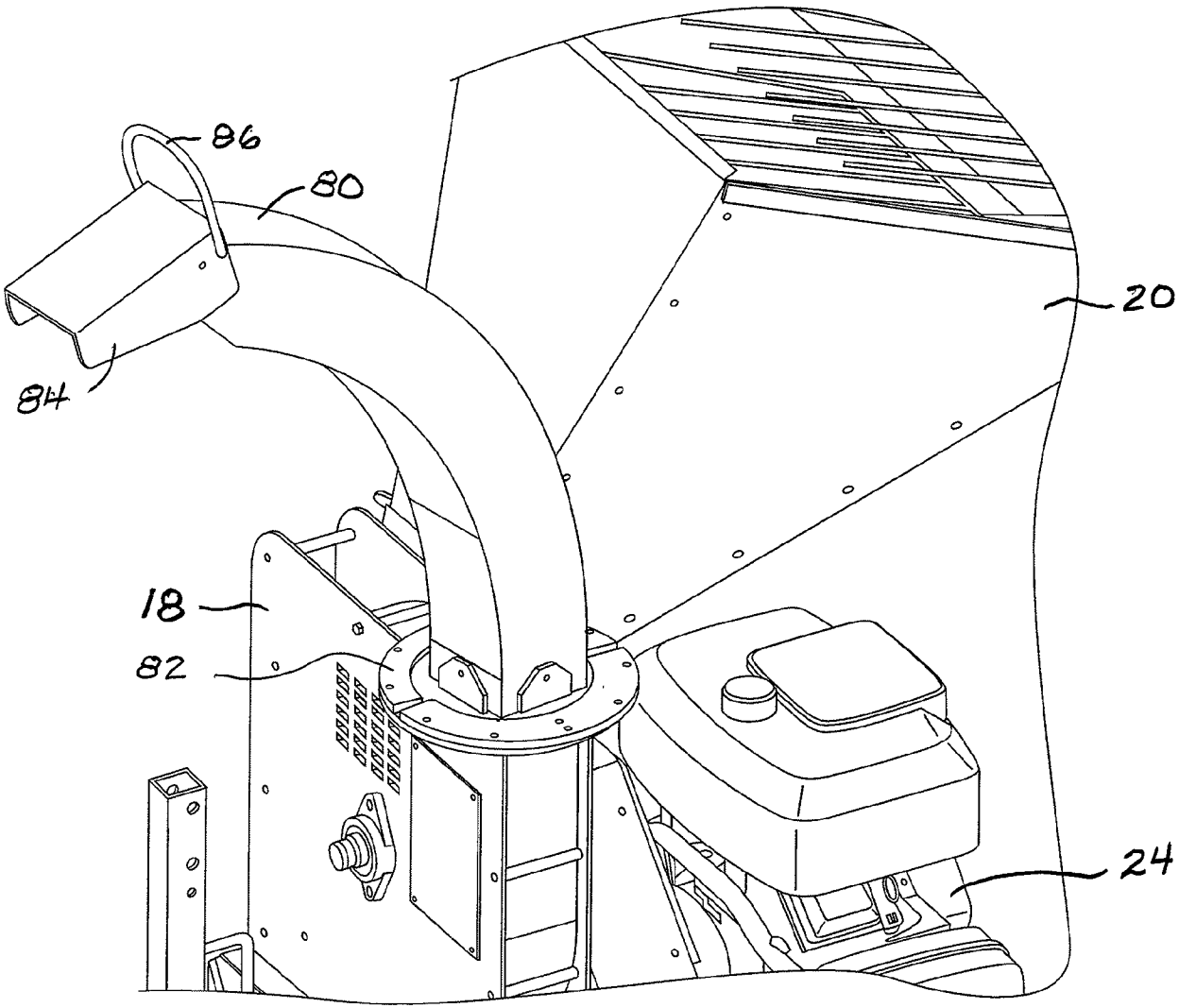
FIG. 7 is an enlarged perspective view of a portion of the wood chipper illustrating a high discharge swivel chute mounted thereto.

The disk charge chute 22 shown in FIG. 1 is a low discharge chute which is attached to the discharge opening and which discharges the chipped material to one side of the wood chipper. An alternate form of discharge chute is shown in FIG. 7 wherein the discharge chute 80 is a high discharge chute which is mounted for swivel movement by a swivel connection 82 so that the discharge may be pointed in different directions. A deflected 84 is pivotally mounted on the end of the discharge chute 80 and has a handle 86 to adjust the angle of the deflector. The swivel connection 82 limits the angle of rotation of the high discharge chute to 180 degrees. This angle of rotation limits the discharge from being directed towards an operator zone. Selector holes in the swivel connection let an operator select various angles of discharge that can be positively locked in so that the angle does not change do to vibration.

Figure 4:
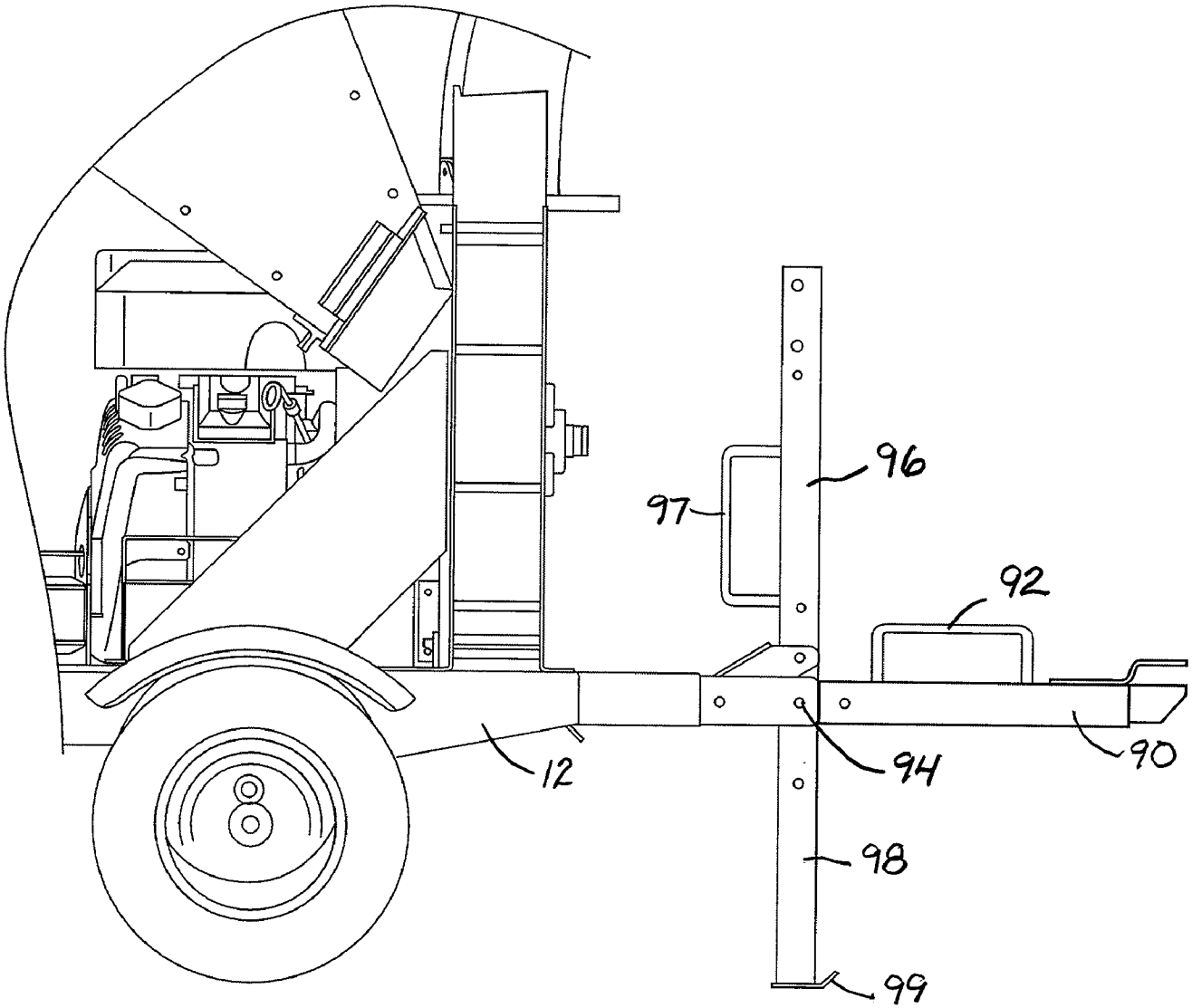
FIG. 4 is a left side elevational view showing the wood chipper of FIG. 1 with an alternate form of a hitch.

The hitch 16 shown in FIG. 1 has a short tongue and a connection at the end for attachment to a vehicle. Shown in FIG. 4 are two alternate forms of hitches 90 and 96. The hitch 90 is a non-highway hitch which extends outwardly from the platform 12 of the wood chipper. The hitch 90 has a handle 92 whereby the hitch can be easily pivoted about a pivot point 94 to a vertical position for storage.

The hitch 96 is alternate form of the hitch which can be substituted for the hitch 90. While both hitches are shown in FIG. 4, only one hitch at a time is employed. The hitch 96 has a handle 97 and is pivotal around pivot point 94 from a horizontal position to a vertical position. When pivoted to the vertical position as shown in FIG. 4, the back end of the hitch 98 has a support plate 99 at the end thereof so that it may support the wood chipper on a surface. The hitch 96 is a highway hitch which is of a sturdier construction and which has a ball hitch connection at the outer end for connection to a vehicle. Although not shown, the hitch 90 also has a back extension whereby when it is pivoted to a vertical position, the back extension also rests on a surface to support the wood chipper. In addition, as shown in FIG. 2, a separate support beam 100 may be provided at the front of the platform to support the wood chipper in a horizontal position.

In operation of the wood chipper of the present invention, wood or other material to be chipped is inserted into the inlet hopper 20 from where it pivots the blow back shield 26 downwardly so that the material passes through the hopper neck 36 and through the housing inlet 34 into the interior of the scroll 63 whereupon the chipper knife 48 from the chipper disk 44 chips the material into small pieces which pass through the slot 54 of the chipper disk to the axial back face 58. After the chips pass through to the axial back face 58, the fins 56 mounted on the axial back face contact the chips and discharge them along with an airflow out through the discharge outlet 62 of the housing and out through the discharge chute 22 or 80.

The inlet hopper is on the same side of the wood chipper as the motor so that the operator never needs to circle around the machine or cross the path of the discharge chute. In the event of an emergency, the operator can also quickly access the engine controls to shut the engine down. This same side configuration makes for a more compact machine having better balance.

Numerous other modifications and adaptations of the present invention would be apparent to those skilled in the art and thus, it is intended by the following claims to cover all such modifications and adaptations which fall within the true spirit and scope of the invention.

What is claimed is:

1. A wood chipper comprising:

a housing having an inlet opening and a discharge outlet;

a chipper disk rotatably mounted in said housing and having a chipper knife mounted on an axial front cutting face thereof and a chipper slot adjacent said chipper knife and extending through said front cutting face to an axial back face;

a plurality of fins mounted on said back face of said chipper disk;

a motor for driving said chipper disk;

an inlet hopper connected to said inlet opening; and a blow back shield mounted to an upper end portion of said hopper, said shield comprising an outer layer of clear synthetic material extending across said hopper and an inner layer of synthetic material extending part way underneath a length of said layer of clear synthetic material.

2. The wood chipper according to claim 1 wherein said inner layer has safety warning information thereon which is visible through said outer layer of clear plastic material.

3. The wood chipper according to claim 1 which further comprises a discharge chute connected to said discharge outlet and inwardly angled plates around at least part of said discharge outlet which focus material being discharged towards a center of said discharge chute.

4. The wood chipper according to claim 3 which further comprises vent holes in a wall of said housing which add airflow to said housing.

5. The wood chipper according to claim 3 wherein said discharge chute is mounted for swivel movement with respect to said discharge outlet.

6. The wood chipper according to claim 1 wherein handle holes are provided adjacent a top portion of a back wall of said inlet hopper.

7. The wood chipper according to claim 1 which further comprises a wheeled platform and a hitch mounted to said platform.

8. The wood chipper according to claim 7 wherein said hitch has an outer end portion pivotally connected to an inner hitch portion whereby said outer end portion is pivotable from a horizontal towing position to an upright position to support said platform in a horizontal position.

9. The wood chipper according to claim 1 wherein said inlet hopper includes a neck portion connecting the hopper to said inlet opening and a replaceable wear plate is attached to a bottom wall inside of said neck portion at the inlet opening.

10. The wood chipper according to claim 9 which further includes a side anvil attached to each side of said inlet opening on the inside of said inlet hopper.

11. The wood chipper according to claim 9 wherein said inlet hopper is connected to said neck portion by bolts on the outside of said hopper and said neck portion.

12. The wood chipper according to claim 1 wherein said chipper knife is removably mounted to said chipper disk.

* * * * *